US007652552B2

(12) United States Patent
Fussl et al.

(10) Patent No.: US 7,652,552 B2
(45) Date of Patent: Jan. 26, 2010

(54) FUSE UNIT

(75) Inventors: Peter Fussl, Vilsbiburg (DE); Michael Sessner, Remseck (DE); Hans Weiner, Muhlacker (DE); Oliver Frohlich, Bietigheim-Bissingen (DE)

(73) Assignees: Lisa Dräxlmaier GmbH, Vilsbiburg (DE); Dr. Ing, h.c.F. Porsche AG, Stuttgart (DE)

( * ) Notice: Subject to any disclaimer, the term of this patent is extended or adjusted under 35 U.S.C. 154(b) by 191 days.

(21) Appl. No.: 11/805,419

(22) Filed: May 23, 2007

(65) Prior Publication Data

US 2008/0042795 A1 Feb. 21, 2008

(30) Foreign Application Priority Data

May 24, 2006 (DE) ..... 10 2006 024 391

(51) Int. Cl.
*H01H 85/04* (2006.01)

(52) U.S. Cl. ..... 337/188; 337/186; 337/187; 337/189; 337/191

(58) Field of Classification Search ..... 337/191, 337/186–189
See application file for complete search history.

(56) References Cited

U.S. PATENT DOCUMENTS

| | | | | | |
|---|---|---|---|---|---|
| 4,842,534 | A * | 6/1989 | Mobley et al. | ..... | 439/214 |
| 4,884,050 | A * | 11/1989 | Kozel | ..... | 337/264 |
| 5,346,411 | A * | 9/1994 | Nikkinen | ..... | 439/620.26 |
| 5,643,693 | A * | 7/1997 | Hill et al. | ..... | 429/121 |
| 5,886,611 | A * | 3/1999 | Schaller et al. | ..... | 337/189 |
| 5,977,859 | A * | 11/1999 | Kawamura et al. | ..... | 337/295 |
| 6,215,636 | B1 * | 4/2001 | Hellemans | ..... | 361/104 |
| 6,294,978 | B1 * | 9/2001 | Endo et al. | ..... | 337/166 |
| 6,476,705 | B1 * | 11/2002 | Betti et al. | ..... | 337/161 |
| 6,509,824 | B2 * | 1/2003 | Inaba et al. | ..... | 337/295 |
| 6,512,443 | B1 * | 1/2003 | Matsumura et al. | ..... | 337/189 |
| 6,558,198 | B2 * | 5/2003 | Kobayashi et al. | ..... | 439/620.29 |
| 6,566,599 | B2 * | 5/2003 | Sumida et al. | ..... | 174/50 |
| 6,759,938 | B2 * | 7/2004 | Matsumura et al. | ..... | 337/161 |
| 6,824,430 | B2 * | 11/2004 | Matsumura et al. | .... | 439/620.29 |
| 7,071,808 | B2 * | 7/2006 | Nakamura | ..... | 337/256 |
| D560,172 | S * | 1/2008 | Ohta et al. | ..... | D13/161 |
| D575,746 | S * | 8/2008 | Bold | ..... | D13/161 |
| 7,420,453 | B2 * | 9/2008 | Matsumura et al. | ..... | 337/295 |
| 2001/0050608 | A1 | 12/2001 | Evans et al. | | |

FOREIGN PATENT DOCUMENTS

| | | | |
|---|---|---|---|
| DE | 29620424 | U1 | 1/1997 |
| DE | 19646264 | C2 | 5/1998 |
| DE | 10211919 | A1 | 10/2002 |
| DE | 10247307 | B3 | 10/2002 |
| JP | 2000-030600 | A | 1/2000 |
| JP | 2002-051432 | A | 2/2002 |

* cited by examiner

*Primary Examiner*—Anatoly Vortman
(74) *Attorney, Agent, or Firm*—Wolf, Greenfield & Sacks, P.C.

(57) ABSTRACT

A fuse unit for use in e.g. motor vehicles, includes an electrically conductive busbar and a plurality of connections for individual power consuming components which are connected to the busbar directly or by way of interposed fusible links so as to be electrically conductive. The busbar has a contact blade adapted to plug into a mating connector of a power supply without the interposition of a further connection between them.

16 Claims, 4 Drawing Sheets

FUSE UNIT

CROSS REFERENCE TO RELATED APPLICATION

Foreign priority benefits are claimed under 35 U.S.C. §119 (a)-(d) or 35 U.S.C. §365(b) of German Application No. DE 10 2006 024 391.9, filed May 24, 2006, which is hereby incorporated by reference in its entirety.

BACKGROUND

1. Field

The present invention relates to fuse units with multiple connections, and in particular fuse units for motor vehicles.

2. Discussion of Related Art

In the automotive industry, cable distributors are used, which feed current from a common source to the connections of individual power consuming components via individual fuses.

Fuses that are mounted on a common busbar or that are integrated in a busbar are already known. Such components are connected on both the incoming and the outgoing side via a screwed-on connector part. Alternatively, individual plug-in contacts may be provided on the fuses of the outgoing side. Such prior devices are described in DE 196 46 264 C2 where current supply connection is attached on the incoming side by way of a busbar by way of a main fusible element. On the outgoing side, a plurality of connector pieces are provided, which are individually connected to the busbar by way of fusible elements. In this regard, the fusible elements on the outgoing side may be preassembled in varying widths and/or thicknesses in relation to their melting behavior. A hole may be provided in the connector pieces on both the incoming and the outgoing side respectively for the attachment of a terminal end or for a screw terminal.

SUMMARY

According to one embodiment, a fuse unit is provided. The fuse unit includes an electrically conductive busbar and a plurality of connections for individual power consuming components connected to the busbar directly or by way of interposed fusible links so as to be electrically conductive. The busbar has a contact blade adapted to be brought into conductive contact with an external power source without an interposition of a further connection.

In yet another illustrative embodiment, a fuse unit is provided. The fuse unit includes an electrically conductive busbar and a contact blade formed at one edge of the busbar. A plurality of connections for individual power consuming components are formed at another edge of the busbar. The contact blade is adapted to directly and repeatedly slidably engage and disengage a mating contact of a power source Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
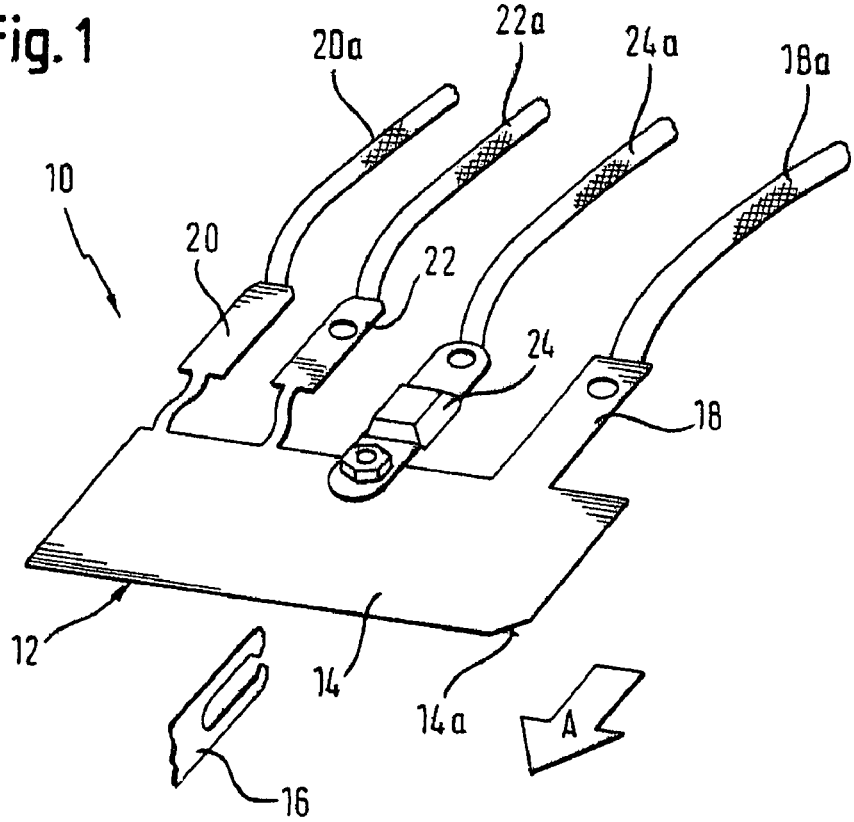
FIG. 1 represents a fuse unit without a surrounding housing.

Aspects of the invention are directed to a device for disconnecting lead wires from a power supply to enable easy assembly and disassembly, as may be necessary, for example, during long vehicle transport or immobilization times. In one embodiment, a fuse unit adapted for use in motor vehicles includes an electrically conductive busbar for connection to a power supply and a plurality of connections for individual power consuming components, which are connected to the busbar directly or by way of interposed fusible links so as to be electrically conductive. The busbar has a contact blade which is adapted to be brought, without the interposition of a further connection, into conductive contact with a power supply. In other words, the busbar has a dual function: on one hand it serves to deliver the current supplied to the plurality of connections for individual power consuming components; on the other hand, with its contact blade, the busbar is used directly as a plug. The busbar is thus no longer connected to a connecting piece provided separately, which is connected in turn to the external power supply, but is rather plugged directly into appropriately shaped mating contacts on the incoming side. In this way, a simply constructed fuse unit is provided which may be repeatedly connected and disconnected in a convenient manner. In this manner, it is possible to uncouple a number of power consuming components from the power supply with a single action. This may be desirable, for example, in heavy-current vehicle applications, because such heavy-current applications can rapidly deplete the vehicle's battery capacity during long-immobilization or transport times. It should be appreciated that the present invention is not limited in this regard, as other applications for a quick disconnect are contemplated. For example, unplugging special power consuming components and/or systems in a vehicle may be desired, such as may be the case with the alarm system of a vehicle, which would otherwise be triggered automatically during loading and unloading of vehicles onto transport vehicles or in the case of abrupt changes of position during transport, e.g., as may occur on the high seas.

In one embodiment, the busbar is a punched sheet having a material thickness matched to be insertable into laminated contacts. Such laminated contacts are described in DE 101 49 572 C2 and include two contact springs which are joined together in a single piece in a base region, whereby each contact spring forms a lever arm. As the contact plate is pushed between the contact arms, the arms are resiliently bendable and are securely held on the busbar due to the pretensioning force on the arms. Such laminated contacts represent very simple contacting between the busbar and the external power supply which may be created with a single action. In addition, the current flow to be transmitted may be adjusted via the number of laminated contacts. Such laminated contacts may be combined into packages. Other suitable mating connections may be employed, as the present invention is not limited in this respect.

In one embodiment, the busbar is a substantially rectangular sheet, the longitudinal or transverse side edge, of which represents the contact blade. In one embodiment, the busbar is a punched sheet having a folded edge which surrounds the contact blade of the busbar. The folded edge allows the possibility of different plug-in geometries because, by appropriate edge folding, the plug surrounding the fuse unit may be brought into any angled disposal in relation to the 2-dimensional disposal of the punched sheet. Thus, for example, the plug may be bent 90° relative to the punched sheet or turned through 90° outwards from the area. Any other angle is also possible, as the present invention is not limited in this respect.

The plurality of fusible links between the busbar and the individual power consuming components may be formed as punch-integrated fuses with plug-in connectors. Alternatively, one or a plurality of punch-integrated fuses may be provided with screwed connections or provided one or a plurality of standard fuses screwed onto the busbar. The use of the busbar also makes it possible to combine different types of fuses in the fuse unit to provide variability in the melting behavior of the fuses and thus the triggering level of the fuse. The possibility of retrofitting a new fuse if the fuse originally installed has been tripped is also achievable. Any suitable fusible link may be employed, as the present invention is not limited in this respect.

In one embodiment, the busbar is made of low-oxygen copper, which is a suitable material for the most even distribution possible of the power applied on the incoming side with a relatively small size of the busbar. The busbar may be coated with tin or a tin alloy. However, other suitable materials and/or coatings may be employed, as present invention is not limited in this regard.

In one embodiment, the fuse unit further includes a housing of electrically insulating material at least partially surrounding the busbar and the fuses. Such a housing forms a contour which may serve for guiding, fixing, locating, latching and screwing of the fuse unit with a mating element. In one embodiment, the housing may carry a code in order to render the individual connections exiting from the fuse unit identifiable. Also, the housing may serve to offer protection against mechanical impacts and/or undesirable faulty contacting of a part of the fuse unit in the vehicle. The housing can also protect the fuse unit against thermal and chemical effects as well as against atmospheric conditions.

The housing may be formed by extrusion coating or foaming in place. This technique may be easily manufacturable and may ensure a tight seal of the housing to prevent undesirable ingress of moisture. However, access to the individual fusible links and connections may not be possible or may be rendered more difficult in the event of repair. Alternatively, the housing may be formed with single shell whereby the contact blade of the busbar projects out of the housing. The housing may completely surround the fuse unit and have a slot in the vicinity of the contact blade dimensioned to enable a mating contact to be pressed into the housing. Furthermore, the housing may be formed with multiple shells coupled together whereby the contact blade projects out of the housing. Other suitable techniques for providing a housing may be employed, as the present invention is not limited in this regard.

The housing may also serve to guide the lead wires of the cables as well as to separate the individual connections from each other by the provision of insulating spacing ligaments.

In one embodiment, the housing has an additional securing arrangement to detachably join, e.g., lock, the housing to a mating component of the external power source. In this manner, in addition to the electrically conductive contact between the contact blade of the busbar and the external power source, a further latching connecting between insulating housing elements is established. No separate step is necessary for detachably joining the housing to the housing of the power source.

Turning now to the figures, FIG. 1 shows one embodiment of the invention which is formed of a punched part punched out of a sheet made from low-oxygen copper. The punched part comprises a busbar 12, the front region of which represents contact blade 14. Other suitable manufacturing techniques may be employed, as the present invention is not limited to punching techniques.

The busbar is substantially rectangular, but may also in the region of the contact rail have a special identification geometry 14*a*. This geometry 14*a* may aid with inserting the fuse unit 10 into a mating element in the correct manner. In this case, for example, an appropriately shaped contour may be provided on the mating element which allows the busbar to be inserted in the correct orientation or which allows insertion of the correct busbar where a plurality of busbars is provided in a vehicle. Of course, the present invention is not limited in this respect, as other orientation arrangements or no orientation arrangement, need be employed.

Figure 3:
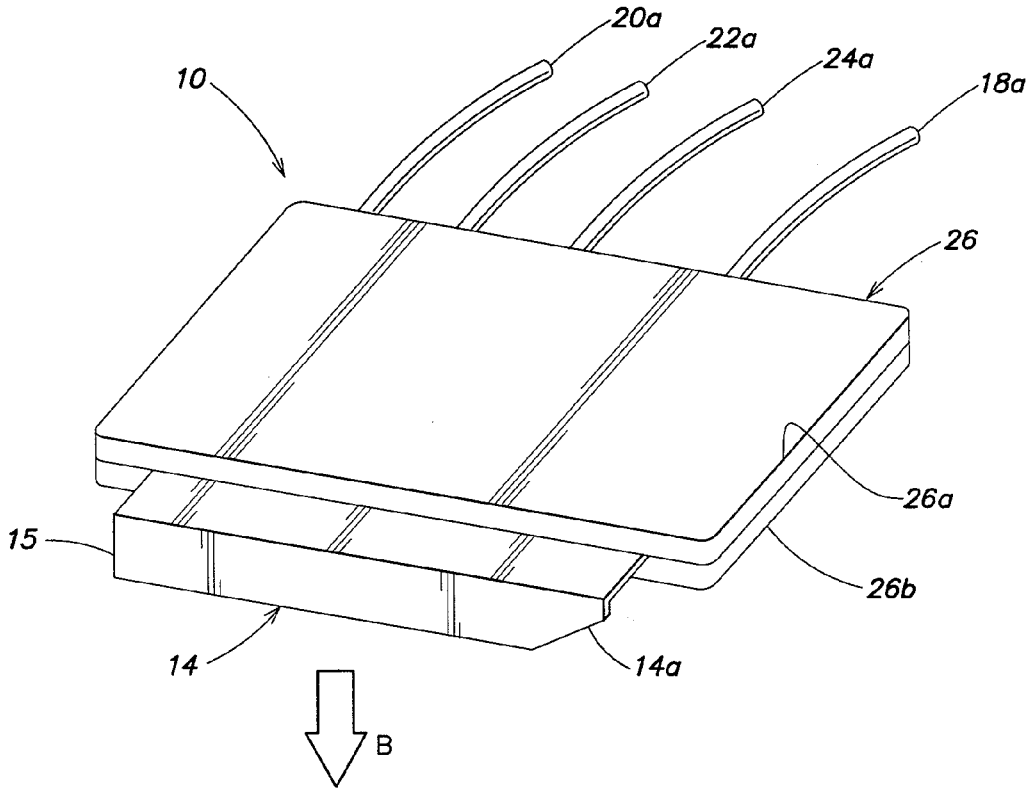
FIG. 3 represents an alternative fuse unit.

In the embodiment shown in FIG. 1, contact blade 14 is plugged in in fixing direction A. However, as shown in FIG. 3, contact blade 14 may include an edge fold 15, which would results in a different plug-in direction B. Mating connector 16 is represented schematically in FIG. 1 in the form of what is known as a laminated contact. Connector 16 represents an example of a mating contact and shows the direction in which the busbar may be plugged into the mating connector 16. Other mating connectors may be employed, as the present invention is not limited in this respect.

The side of busbar 12 opposite contact blade 14 includes connections to external power consuming components. While attachment lug 18 represents an unfused arrangement, in which no fuse is interposed between the busbar and cable 18*a* leading to the external power consuming component, fusible links may be provided on one or more of the other connections. Various alternative fusible and/or non-fusible links are conceivable, which may be provided on the busbar individually or in any suitable combination. In one embodiment, a screwed standard fuse 24 is provided whereas fuses 20 and 22 are each punched grid-integrated fuses (SIS). SIS 20 has a plug-in connection for cable 20*a* leading to the external power consuming component, whereas SIS 22 has a screwed connection for cable 22*a*. In the schematic representation of FIG. 1, the connections between cables 18*a*, 20*a*, 22*a* and 24*a* and the corresponding securing contour on the attachment lug or the fuses have not been described in great detail, as such attachment arrangements are readily apparent to the person of skill in the art. The cables are connected directly onto the fuses by any suitable arrangement, such as screwing, plugging, welding, soldering, embossing or other arrangements known to those skilled in the art.

Figure 2:
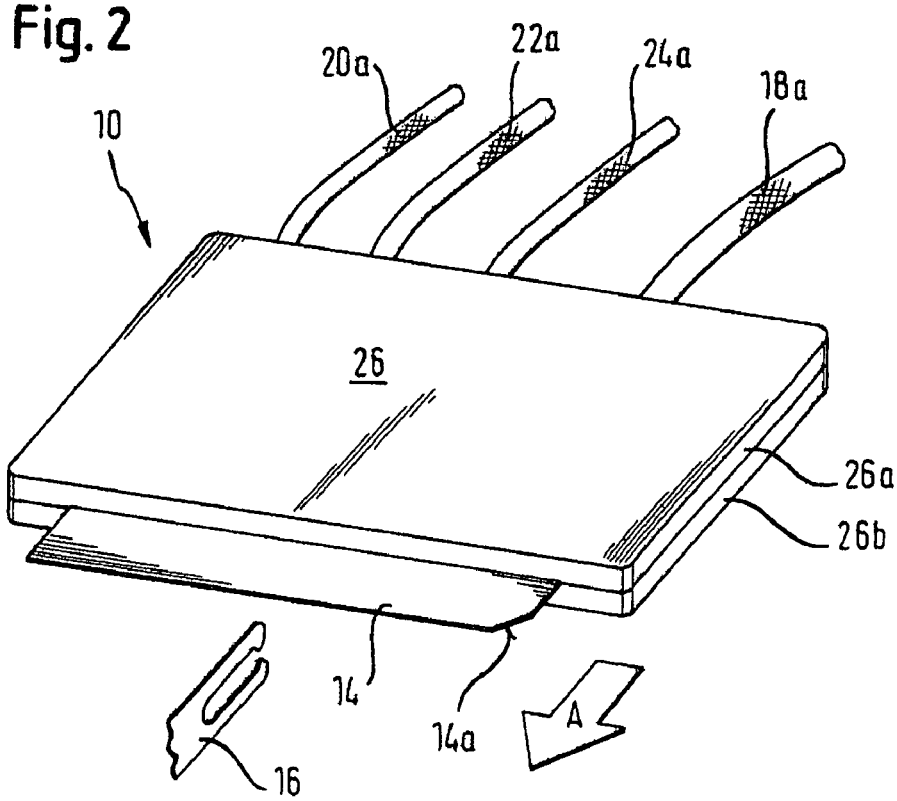
FIG. 2 represents the fuse unit of FIG. 1 with a surrounding housing.
Figure 5:
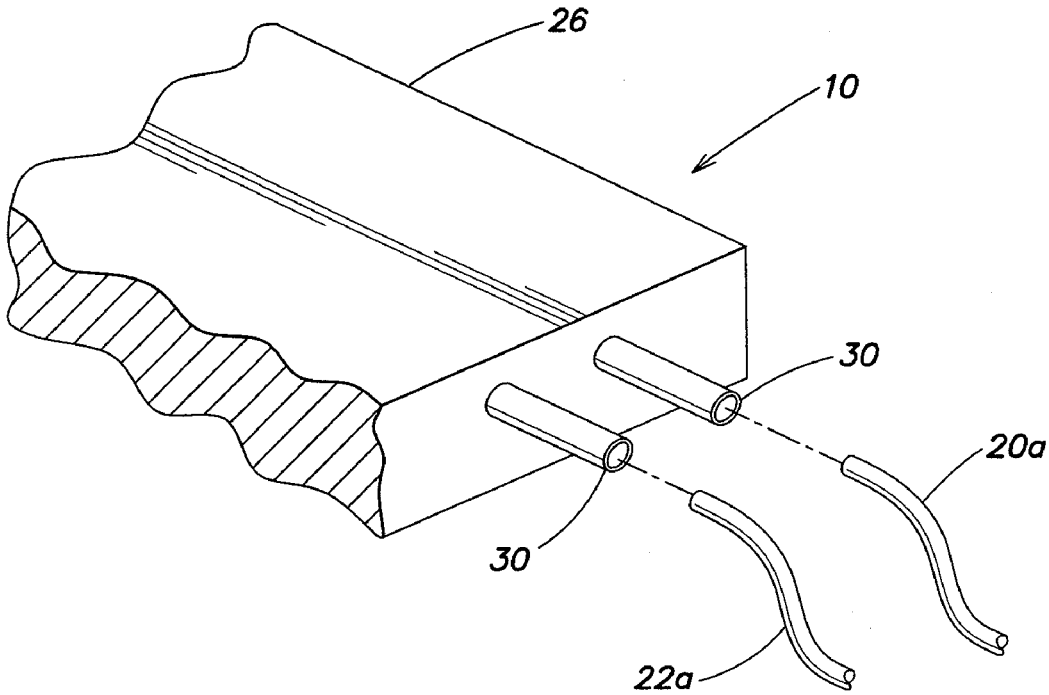
FIG. 5 represents wire guides disposed on the fuse unit.

No housing is shown in the basic unit illustrated in FIG. 1, although in one embodiment, unit 10 comprises a surrounding housing made from an electrically insulating material, such as a suitable plastic material. FIG. 2 shows a variation of a housing 26 having two housing halves 26*a* and 26*b* firmly joined together. The housing is advantageously divided in the region of contact blade 14. The housing may include separate bushings 30 (see FIG. 5, which shows a partial rear view of the housing 26), for connection cables 18*a*, 20*a*, 22*a* and 24*a* guided to the external power consuming components. Other suitable guides may be employed, as the present invention is not limited in this respect.

In one embodiment, the housing is formed as a single shell or by extrusion coating or foaming on the plate 12.

Figure 4:
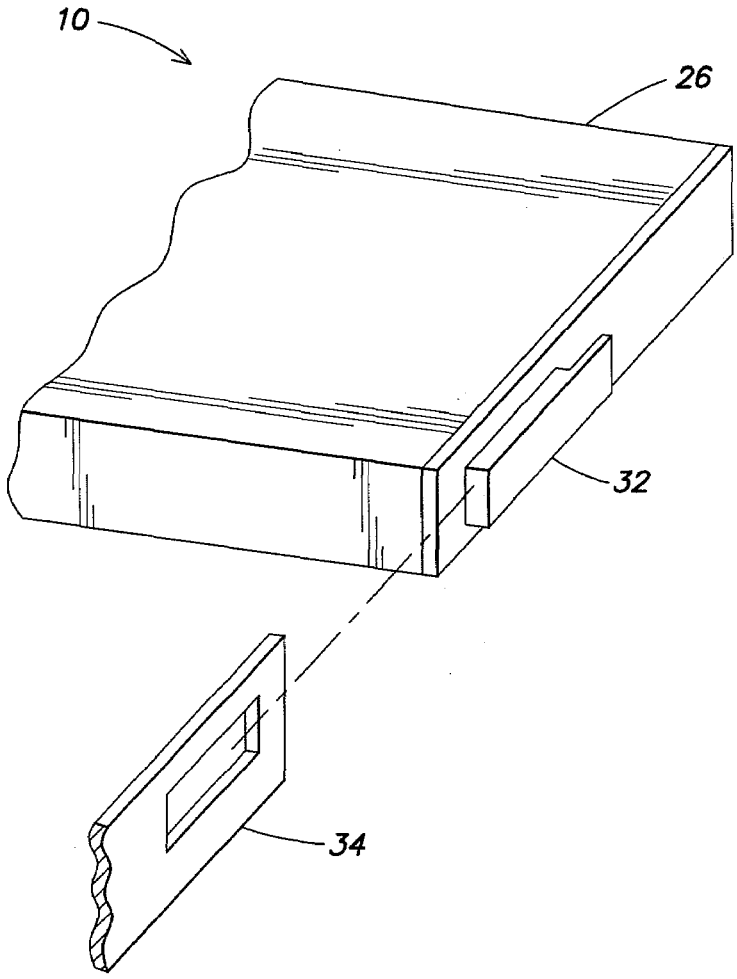
FIG. 4 represents a locking arrangement for the fuse unit.

In one embodiment, as shown in FIG. 4, the housing includes a securing arrangement 32 adapted to engage into a correspondingly shaped mating lock 34 of the fuse unit's mating component (not shown) upon insertion of the fuse unit. Such an arrangement may serve as a mechanical latching of the fuse unit in the corresponding mating connector. Other suitable locking arrangements may be employed, as the present invention is not limited in this regard.

In one embodiment, the housing may be formed to absorb forces during operation, installation and assembly and to protect the busbar represented in FIG. 1. Of course, the present invention is not limited in this respect, as the busbar and fuses may be provided without a housing. When employed, the housing may be designed such that the lead-in of the cables need not be guided in the plug, as the present invention is not limited in this regard. This may be desirable, for example, if the outgoing cables are intended to be combined in a common cable harness.

The fuse unit functions as a busbar which serves to distribute the current to the connections of the power consuming components and serves to bring the contact plug into contact with an external power supply without the interposition of a separate connection.

Having thus described several aspects of at least one embodiment of this invention, it is to be appreciated various alterations, modifications, and improvements will readily occur to those skilled in the art. Such alterations, modification, and improvements are intended to be part of this disclosure, and are intended to be within the spirit and scope of the invention. Accordingly, the description and drawings herein are by way of example only.

What is claimed is:

1. A fuse unit comprising:

an electrically conductive busbar;

a plurality of connections for individual power consuming components connected to the busbar directly or by way of interposed fusible links so as to be electrically conductive;

wherein the busbar has a contact blade to be brought into conductive contact with an external power source without an interposition of a further connection; and a housing of electrically insulating material at least partially surrounding the busbar, the housing being formed with multiple shells joined together whereby the contact blade projects out of the housing, the housing including a securing arrangement to detachably lock the housing to a mating power supply component.

2. The fuse unit according to claim 1, wherein the busbar is a punched sheet, the material thickness of which is matched to insertion into a correspondingly shaped mating connector.

3. The fuse unit according to claim 1, wherein the busbar is a punched sheet having a folded edge on the contact blade of the busbar.

4. The fuse unit according to claim 1, further comprising interposed fusible links between the busbar and the plurality of connections, wherein at least one of the fusible links is a punch grid-integrated fuse with plug-in connection.

5. The fuse unit according to claim 1, further comprising interposed fusible links between the busbar and the plurality of connections, wherein at least one of the fusible links is a punch grid-integrated fuse with screw connection.

6. The fuse unit according to claim 1, further comprising interposed fusible links between the busbar and the plurality of connections, wherein at least one of the fusible links is a standard fuse screwed onto the busbar.

7. The fuse unit according to claim 1, further comprising interposed fusible links between the busbar and the plurality of connections, wherein at least two different fusible links selected from the group comprising punch grid-integrated fuses with plug-in connection, punch grid-integrated fuses with screw connection, and screwed standard fuses are disposed on the busbar.

8. The fuse unit according to claim 1, wherein the busbar is made from low-oxygen copper.

9. The fuse unit according to claim 1, wherein the busbar is coated with tin or a tin alloy.

10. The fuse unit according to claim 1, wherein lead-in of cables from the power consuming components is adapted to be guided in the housing.

11. The fuse unit according to claim 1, further comprising interposed fusible links between the busbar and the plurality of connections, wherein the housing at least partially surrounds the fusible links.

12. A fuse unit comprising:

an electrically conductive busbar;

a contact blade formed at one edge of the busbar;

a plurality of connections for individual power consuming components formed at another edge of the busbar;

wherein the contact blade is configured to directly and repeatedly slidably engage and disengage a mating contact of a power source; and a housing of electrically insulating material at least partially surrounding the busbar, the housing being formed with multiple shells joined together whereby the contact blade projects out of the housing, the housing including a securing arrangement to detachably lock the housing to a mating power supply component.

13. The fuse unit according to claim 12, further comprising a plurality of fusible links disposed between at least some of the plurality of connections and the busbar.

14. The fuse unit according to claim 12, wherein the contact blade is exposed for connection to the mating contact of the power source.

15. The fuse unit according to claim 12, wherein the contact blade is formed with a folded edge.

16. The fuse unit according to claim 12, further comprising a plurality of bushings disposed on the housing, the bushings adapted to receive and guide lead-in cables from the power consuming components to at least one of the busbar and the housing.

* * * * *